US010553942B2

(12) United States Patent
Yi et al.

(10) Patent No.: US 10,553,942 B2
(45) **Date of Patent: *Feb. 4, 2020**

(54) SYSTEMS AND METHODS FOR RECONFIGURABLE FACETED REFLECTOR ANTENNAS

(71) Applicant: Orbital Sciences Corporation, Dulles, VA (US)

(72) Inventors: Jack Yi, Ashburn, VA (US); Joseph Christopher Cardoso, Hemdon, VA (US); Martin Edwards, Indialantic, FL (US)

(73) Assignee: Orbital Sciences Corporation, Dulles, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/031,499

(22) Filed: Jul. 10, 2018

(65) Prior Publication Data

US 2019/0190145 A1 Jun. 20, 2019

Related U.S. Application Data

(63) Continuation of application No. 15/615,563, filed on Jun. 6, 2017, now Pat. No. 10,020,576, which is a (Continued)

(51) Int. Cl.

| | |
|---|---|
| ***H01Q 3/20*** | (2006.01) |
| ***H01Q 15/14*** | (2006.01) |
| ***H01Q 15/16*** | (2006.01) |

(52) U.S. Cl.

CPC ..... *H01Q 3/20* (2013.01); *H01Q 15/147* (2013.01); *H01Q 15/165* (2013.01); *H01Q 15/167* (2013.01)

(58) Field of Classification Search

CPC ..... H01Q 3/20; H01Q 15/147; H01Q 15/165; H01Q 15/167

See application file for complete search history.

(56) References Cited

U.S. PATENT DOCUMENTS

| | | | |
|---|---|---|---|
| 3,401,390 A | 9/1968 | Braccini et al. | |
| 3,882,503 A | 5/1975 | Gamara | |

(Continued)

FOREIGN PATENT DOCUMENTS

| | | | | |
|---|---|---|---|---|
| EP | 2040330 A1 | 3/2009 | | |
| WO | WO 03/058761 A1 | 7/2003 | | |
| WO | WO-03058761 A1 * | 7/2003 | ..... | H01Q 15/147 |

OTHER PUBLICATIONS

Schell, A.C., "The Multiplate Antenna," *IEEE Transactions on Antennas and Propagation*, vol. AP-14, No. 5, pp. 550-560, XP001383047 (Sep. 1, 1966).

*Primary Examiner* — Hoang V Nguyen
(74) *Attorney, Agent, or Firm* — Christensen, Fonder, Dardi & Herbert PLLC

(57) ABSTRACT

Systems and methods are disclosed herein for a reconfigurable faceted reflector for producing a plurality of antenna patterns. The reconfigurable reflector includes a backing structure, a plurality of adjusting mechanisms mounted to the backing structure, and a plurality of reflector facets. Each of the plurality of reflector facets is coupled to a respective one of the plurality of adjusting mechanisms for adjusting the position of the reflector facet with which it is coupled. The reflector facets are arranged to produce a first antenna pattern of the plurality of antenna patterns. By adjusting the plurality of adjusting mechanisms, the position of each of the reflector facets coupled to the respective one of the plurality of adjusting mechanisms is adjusted so that the reflector facets are arranged to produce a second antenna pattern of the plurality of antenna patterns.

20 Claims, 12 Drawing Sheets

Related U.S. Application Data continuation-in-part of application No. 14/925,291, filed on Oct. 28, 2015, now Pat. No. 9,673,522, which is a continuation of application No. 13/834,214, filed on Mar. 15, 2013, now Pat. No. 9,203,156.

(56) References Cited

U.S. PATENT DOCUMENTS

| | | | |
|---|---|---|---|
| 4,463,749 | A | 8/1984 | Sobczak et al. |
| 4,750,002 | A | 6/1988 | Kommineni |
| 5,063,389 | A | 11/1991 | Reits |
| 5,440,320 | A | 8/1995 | Lach et al. |
| 9,203,156 | B2 | 12/2015 | Yi et al. |
| 9,673,522 | B2 | 6/2017 | Yi et al. |
| 10,020,576 | B2 | 7/2018 | Yi et al. |
| 2012/0092225 | A1 | 4/2012 | Schreider et al. |
| 2012/0229355 | A1 | 9/2012 | Scolamiero et al. |
| 2013/0214984 | A1 | 8/2013 | Zaghloul et al. |

* cited by examiner

SYSTEMS AND METHODS FOR RECONFIGURABLE FACETED REFLECTOR ANTENNAS

CROSS-REFERENCE TO RELATED APPLICATION

This application is a continuation of U.S. patent application Ser. No. 15/615,563, filed Jun. 6, 2017, now U.S. Pat. No. 10,020,576, which issued Jul. 10, 2018 which is a continuation-in-part of U.S. patent application Ser. No. 14/925,291, filed Oct. 28, 2015, now U.S. Pat. No. 9,673,522, issued Jun. 6, 2017, which is a continuation of U.S. patent application Ser. No. 13/834,214, filed Mar. 15, 2013, now U.S. Pat. No. 9,203,156, issued Dec. 1, 2015, all of which are incorporated herein by reference in their entireties.

BACKGROUND

Commercial geostationary satellites typically employ shaped reflector antennas to produce directivity patterns contoured to desired coverage areas. For example, commercial satellites may have reflectors designed to produce antenna pattern contours that mimic the borders of the continental United States (CONUS), Europe, or northern Africa, as projected from orbit, thereby minimizing directivity to unserved regions. Shaped reflector antennas have the advantages of using transponder power more efficiently and having significantly lower mass than other antenna technologies producing similar results, such as phased array antennas. Shaped reflectors also have excellent pattern characteristics (particularly cross-polar discrimination, sidelobe suppression, and other pattern characteristics required for regulatory compliance and inter-operator coordination), high power handling capability, simple deployability on-orbit, and proven on-orbit reliability. These shaped reflectors have continuous, fixed, and doubly-curved surfaces, typically molded with carbon composite materials.

One disadvantage with conventional shaped reflectors is that their shape cannot be altered after manufacture. Geostationary satellites are typically built to have a lifetime of 15 years or more. Over the course of a satellite's lifetime, its operator may want to change its orbital slot or coverage area. However, because shaped reflectors are fixed to a particular orbital slot and coverage area at manufacturing, a satellite that is moved to a different orbital slot and/or is re-oriented to serve a different region would not efficiently illuminate the new coverage area. Another disadvantage with conventional shaped reflectors is that it is often difficult to repair reflector surface errors or mis-shaping after manufacturing, which can cause significant cost and schedule impacts late in satellite production.

Further, satellite manufacturers may need to design antenna systems before a satellite's orbital slot has been assigned or its intended coverage area has been defined. For example, a satellite may have a 100 degree longitudinal range within which its orbital slot will be assigned. The optimal antenna configuration for a particular coverage area depends on the orbital slot since the projected contour of a region of the earth can be dramatically different in size and shape from the vantage point of differing orbital slots. So, when the actual orbital slot is unknown, it is impossible to design an optimal antenna system. When the orbital slot is yet to be determined, the satellite manufacturer may design the reflector for a mid-range position, by averaging the footprint of the two ends of the possible range, or by enveloping all possible patterns across the entire range of projected contours. In any case, the reflector would not have been optimized for the final orbital slot, leading to suboptimal performance.

In another case, a satellite may be re-tasked by the operator in response to changing market demands to an entirely different region from its initially designated deployment, with markedly different contours (for example, moving a satellite designed for CONUS to cover Africa). In that case, the operator is forced to accept partial coverage, tolerate directivity wasted on unserved areas, and coordinate potential interference issues with adjacent satellite operators.

Furthermore, shaped reflector antennas are long-lead, pacing items in the critical path of satellite manufacturing flow and must have the definition of their surfaces finalized over a year before launch, during which time the desired coverage area might change. However, no flexibility currently exists to alter the reflector surface after fabrication.

Lastly, fixed shaped reflectors cannot compensate for one-time and dynamic on-orbit effects, such as hygroscopic distortion, diurnal and seasonal thermal distortion, and various sources of mis-alignments. In addition, fixed reflectors cannot be adjusted to address deterioration in dynamic link conditions such as regional rain fading, uplink interference, and inclined orbit operations during extended satellite life.

SUMMARY

Therefore, there is a need in the art for a reflector that can be reconfigured dynamically on orbit. A reflector that can be reconfigured on orbit would allow the satellite operators to repurpose the satellites for different orbital positions and coverage areas while still achieving optimal or high performance. If an operator's orbital slot and coverage goals change, being able to reconfigure an in-orbit satellite provides a superior result to moving a satellite whose reflectors are optimized for a different coverage area and orbital slot. Reconfiguring an in-orbit satellite is also far more efficient than building and launching in-orbit spares, or designing and launching new satellites as coverage areas or orbital slots change.

Once on orbit, a reconfigurable reflector surface, under closed-loop or open-loop control, would allow adaptive compensation for dynamic effects such as diurnal and seasonal thermal distortion, regional rain fades, spacecraft attitude mis-alignments, and non-static footprints during inclined-orbit operations. Furthermore, other innovative uses of dynamic pattern adjustment capability are possible such as auto-tracking for spot-beam applications, geolocation, and interference/anti-jam nulling.

Additional there is a need in the art for a reflector that can be reconfigured on the ground prior to launch. Such a reflector would not require final pattern coverage definition until late in satellite manufacturing flow, providing significant flexibility to the operator during the acquisition phase. Unlike fixed reflectors, this reconfigurable reflector can easily compensate for manufacturing errors, damage, and misalignments detected prior to launch at minimal cost and schedule impact.

A reconfigurable reflector may be composed of a number of independent reflector facets, some or all of which may have independently adjustable positions and/or orientations. These adjustable positions and/or orientations may be fixed prior to launch or driven by commmandable actuators, allowing reconfiguration on orbit. By independently adjusting the positions and/or orientations of the reflector facets, the reconfigurable reflector can be re-shaped to create a virtually infinite number of coverage footprints and beam shapes. Sufficient pattern control may be achievable by a single degree-of-freedom through linear translation of the facet, greatly simplifying mechanical implementation and reducing size and mass of the antenna system. For static applications, the facet positions can be set and fixed late in manufacturing flow using a common antenna platform across an entire product line, eliminating unique reflector manufacturing for each satellite antenna. For dynamic, on-orbit control, each facet (or a subset of facets) can be integrated with an independent, controllable, actuating mechanism. The facets have rigid surfaces and can be fabricated from common space-qualified materials with significant flight heritage, obviating the need for novel materials such as continuous flexible membranes that continuous adjustable surfaces would require. Similarly, the actuators can be implemented with existing space-qualified materials and designs. The reconfigurable reflector can be a main reflector, subreflector, or both. A reconfigurable reflector can be used in commercial communication satellites, military communication satellites (e.g., Global Broadcast Service), or other applications.

Some embodiments include a reconfigurable faceted reflector for producing a plurality of antenna patterns. The reconfigurable reflector includes a backing structure, a plurality of adjusting mechanisms mounted to the backing structure, and a plurality of reflector facets. Each of the plurality of reflector facets is coupled to a respective one of the plurality of adjusting mechanisms for adjusting the position of the reflector facet with which it is coupled. The reflector facets are arranged to produce a first antenna pattern of the plurality of antenna patterns. By adjusting the plurality of adjusting mechanisms, the position of each of the reflector facets coupled to the respective one of the plurality of adjusting mechanisms is adjusted so that the reflector facets are arranged to produce a second antenna pattern of the plurality of antenna patterns.

In some embodiments, one or more of the adjusting mechanisms are mechanical adjusting mechanisms. In other embodiments, one or more of the adjusting mechanisms are actuators, such as linear actuators. If the adjusting mechanisms are linear actuators, each of the linear actuator may have a corresponding range, and the ranges of the plurality of linear actuators may allow the linear positions of the first number of reflector facets to be optimized for at least two different coverage areas. The linear actuators may be oriented to translate all facets in the same direction, such as towards the feed, towards the aperture, or along another common axis. Alternatively, the linear actuators may independently translate each facet in different directions.

The reflector facets may be substantially flat or curved. The reflector facets may be equally or unequally sized. The shapes of the reflector facets can be, for example, circular, hexagonal, rectangular, square, super-elliptical, trapezoidal, or triangular. In some embodiments, the reconfigurable reflector includes a plurality of fixed reflector facets that are mounted to the backing structure and are not coupled to an adjusting mechanism. The backing structure profile can be, for example, parabolic, ellipsoidal, flat, hyperbolic, or spherical.

In some embodiments, the reconfigurable reflector includes a plurality of tilting mechanisms. Each of the plurality of tilting mechanisms may be coupled to a corresponding one of the plurality of reflector facets to tilt the corresponding one of the plurality of reflector facets relative to the backing structure. In some embodiments, the reconfigurable reflector includes a plurality of translating mechanisms. Each of the plurality of translating mechanisms may be coupled to a corresponding one of the plurality of reflector facets to tilt the corresponding one of the plurality of reflector facets relative to the backing structure. With a plurality of tilting and translating mechanisms, up to 6 degrees of freedom can be provided to each facet's position and orientation.

Another aspect includes a method for antenna pattern shaping with a reconfigurable faceted reflector. The method involves receiving data describing a coverage area and/or a beam shape of a desired antenna pattern and determining, based on the desired coverage area and/or beam shape of the desired antenna pattern, optimal positions for a plurality of reflector facets for radiating the desired antenna pattern. The plurality of reflector facets are coupled to a plurality of adjusting mechanisms for adjusting the positions of the plurality of reflector facets, and the plurality of adjusting mechanisms are mounted to a backing structure. The method further includes adjusting, using the plurality of adjusting mechanisms, the positions and/or orientations of the plurality of reflector facets to the determined optimal positions for the plurality of reflector facets.

In some embodiments, the optimal positions of the plurality of reflector facets minimize antenna directivity to directions and areas outside of the desired coverage area. In some embodiments, one or more of the adjusting mechanisms are mechanical adjusting mechanisms. In such embodiments, the positions of the plurality of reflector facets may be adjusted to the determined optimal positions on the ground.

In other embodiments, one or more of the adjusting mechanisms are actuators, such as linear actuators. In such embodiments, commands for adjusting the positions of the plurality of reflector facets may be transmitted to the actuators. The method may also include receiving a failure condition of at least one of the at least one actuator. In this case, determining the optimal positions of the plurality of reflector facets may be further based on the failure condition of the at least one of the at least one actuator.

In some embodiments, the actuators are linear actuators, and the commands for adjusting the plurality of reflector facet positions are commands for independently adjusting each of the at least one linear actuator to move each of the plurality of reflector facets towards or away from the backing structure.

In some embodiments, the optimal positions of the plurality of reflector facets may be further based on the orbital position of the spacecraft. In other embodiments, the optimal positions of the plurality of reflector facets may be further based on the range of available positions of each of the plurality of reflector facets.

In some embodiments, the plurality of reflector facets, the plurality of adjusting mechanisms, and the backing structure form a main reflector. In such embodiments, the method may involve determining optimal positions of a second plurality of reflector facets coupled to a second plurality of adjusting mechanisms and mounted to a second backing structure. In this case, the second plurality of reflector facets, the second plurality of adjusting mechanisms, and the second backing structure may form a sub-reflector.

In some embodiments, the method involves receiving a second desired coverage area that is different from a first desired coverage area and determining, based on the second desired coverage area, second optimal positions for the plurality of reflector facets for radiating the second desired coverage area. Commands for adjusting the plurality of reflector facet positions to the determined second optimal positions of the plurality of reflector facets for radiating the second desired coverage area may then be transmitted to the adjusting mechanisms.

DETAILED DESCRIPTION

To provide an overall understanding of the invention, certain illustrative embodiments will now be described, including systems and methods for reconfigurable faceted reflectors for producing multiple radiation patterns. However, it will be understood by one of ordinary skill in the art that the systems and methods described herein may be adapted and modified as is appropriate for the application being addressed and that the systems and methods described herein may be employed in other suitable applications, and that such other additions and modifications will not depart from the scope thereof.

Figure 1A:
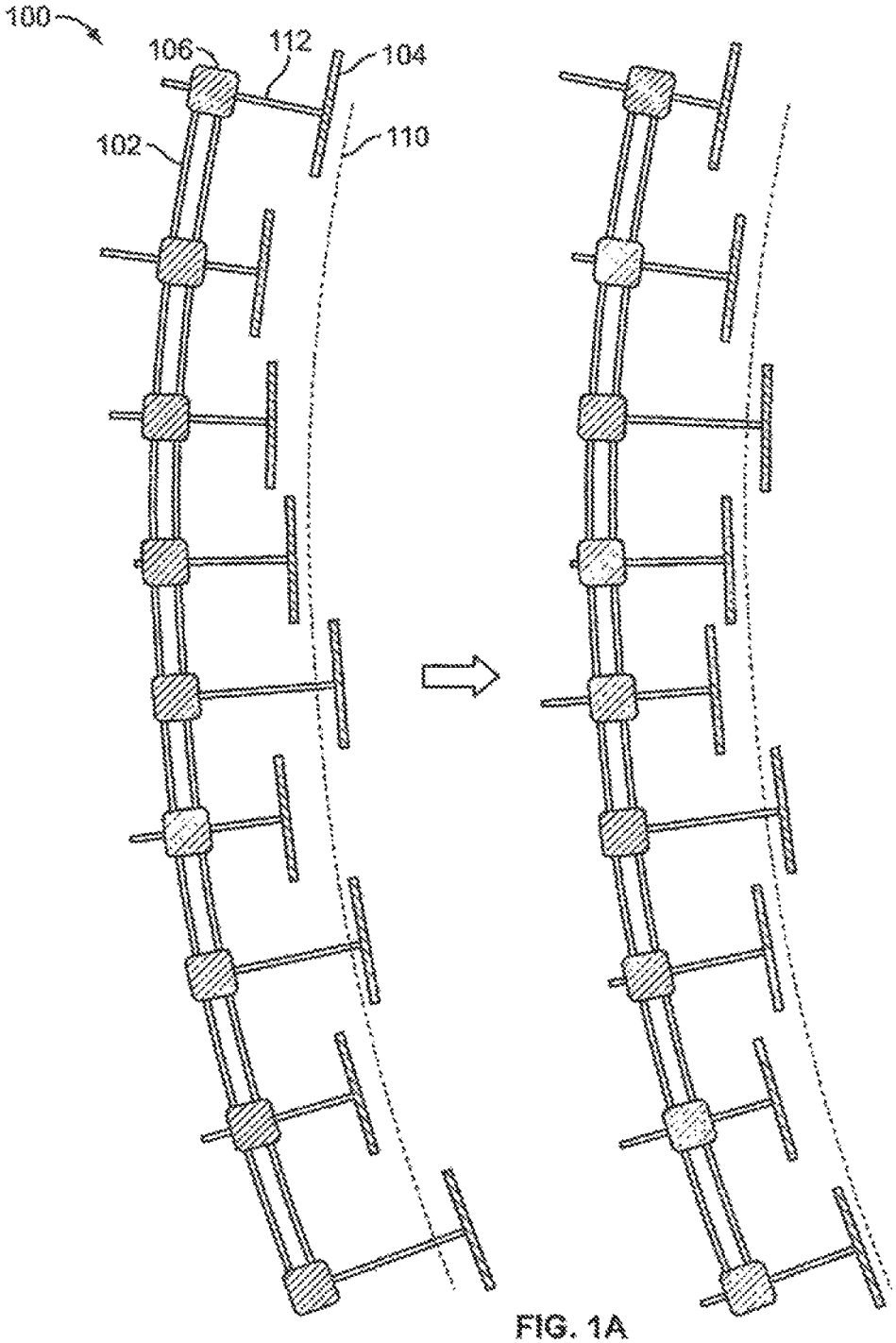
FIG. 1A is a side view of a cross-section of a reconfigurable reflector with equally sized and shaped reflector facets, according to an illustrative embodiment of the invention.
Figure 1B:
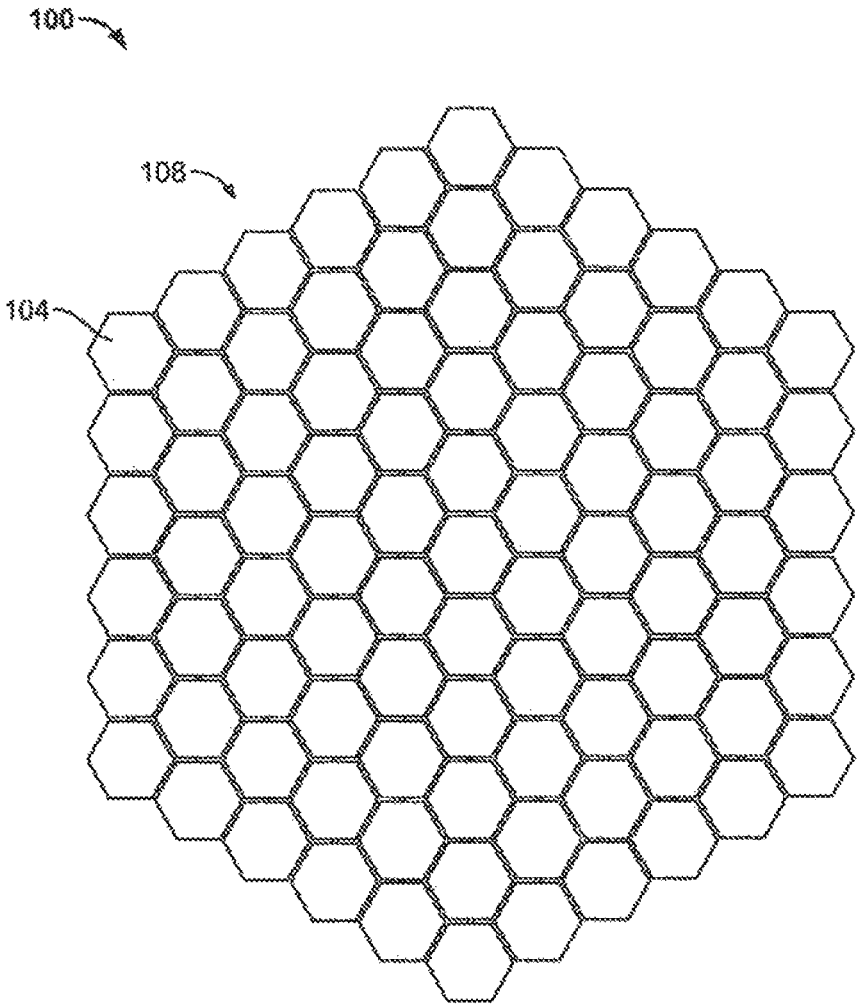
FIG. 1B is a front view of the reconfigurable reflector of FIG. 1A, according to an illustrative embodiment of the invention.

A reconfigurable reflector that can be used to produce multiple different radiation patterns can be composed of multiple reflector facets that are independently movable, with suitable results achievable through a single linear axis of translation. FIGS. 1A and 1B show, respectively, a side view and a front view of a reconfigurable reflector 100 that can be adjusted to produce different radiation patterns. The reconfigurable reflector 100 includes a backing structure 102 and a plurality of reflector facets 104 mounted to the backing structure 102 by a connecting rod 112. The reflector facets 104 form a reflector surface 108. Reflector facets 104 may incorporate edge treatments, such as corrugated surfaces (not shown) on sides of the facets 104 perpendicular to their faces, to reduce the effect of edge scattering. As shown in FIGS. 1A and 1B, actuators 106 can be mounted to the backing structure to allow reconfiguration. Each actuator 106 is positioned between one of the reflector facets 104 and the backing structure 102 to move the connecting rod 112 and its corresponding reflector facet 104 relative to the backing structure 102, e.g., closer to or farther away from the backing structure 102. Adjusting an actuator 106 also causes the corresponding reflector facet 104 to move relative to the other reflector facets 104, thus changing the shape of the reflector surface 108. This allows the reflector surface 108 to be optimized for a desired coverage area, beam shape, and/or orbital slot.

The backing structure 102 may be any backing structure suitable for supporting multiple actuators 106 and multiple reflector facets 104. The backing structure 102 may be convex, as shown, or flat or concave. The backing structure 102 may have a parabolic, ellipsoidal, flat, hyperbolic, or spherical profile. The reflector facets 104 may be made of any material for reflecting electromagnetic waves, such as a carbon composite or aluminum. The individual reflector facets 104 may be flat, as shown, or curved. Flat reflector facets 104 are easier to produce than curved reflector facets because flat reflector production does not involve the creation and use of curved molds. Common facet shapes and/or surface profiles reduce production cost and schedule risk. The actuators 106 may be linear actuators, which come in various types, such as electromechanical and piezo-electrical devices. Linear actuators with space-flight heritage are available. If, for example, the actuators 106 are electromechanical actuators, they each may include a screw-nut pair and a stepper motor; the screw-nut pair translates the rotary motion of the stepper motor to linear output motion.

The actuators 106 may be connected to one or more controllers (not shown) for providing an input signal. An actuator 106 adjusts the position of its connected reflector facet 104 via the connecting rod 112 based on the input signal. The controller may receive a control signal via on-board processing or ground command indicating the desired positions of the reflector facets, and the controller may send input signals to the actuators 106 according to these positions. Alternatively, the control signals may indicate relative adjustments to be made to each reflector facet's position, e.g., a first reflector facet 104 should be moved, for example, 0.50 inches further from the backing structure 102 from its current position, a second reflector facet 104 should be moved 0.25 inches toward the backing structure 102 from its current position, and so forth. Alternatively, the spacecraft may store the optimal actuator settings for one or more coverage patterns; in this case, the ground signal transmits a control signal indicating the coverage pattern to be used. Alternatively, the spacecraft controller may run an algorithm for determining actuator settings for a given coverage pattern, which may be supplied by the ground station.

In some embodiments, an on-board processor may provide autonomous, closed-loop control of the reconfigurable reflector by using on-orbit measurement of facet positions and/or orientations. These measurements may be performed using photogrammetry if optical targets are placed on the facet surfaces. Alternatively, when using a stepper motor, the positions of each of the reflectors may be stored. On-board receivers may provide additional input signals to the facet-positioning algorithms to allow adaptive pattern adjustment, mitigating dynamic, temporal link degradation due to effects such as uplink interference and regional rain fading.

After launch, there may be a risk that one or more actuators 106 fail. In this case, the actuator's failure condition (i.e. the position at which the reflector facet 104 attached to the actuator 106 is fixed, the range of positions now available to the reflector facet 104, or the loss of or damage to a reflector facet 104) can be transmitted to the ground station or accounted for in on-board processing. Based on the failure condition, the configuration of the reflector 100 can be re-optimized, and calculation of future configurations can take into account the failure position to mitigate the impact of the failure.

Additional conditions may also be taken into account when optimizing the configuration of the reflector facets. For example, the reflector configuration may be adjusted to compensate for hygroscopic and diurnal/seasonal temperature distortions. The reflector configuration may additionally, or alternatively, be designed to reduce interference with other satellites, e.g., by on-orbit adjustment of sidelobe and roll-off characteristics. Further, the reconfigurable reflector may be used for dynamic beam-pointing to compensate for misalignments in an antenna system. Beam-pointing may reduce or eliminate the need to use gimbals for repositioning antennas, and can improve coverage in inclined or degraded orbits. Any of these or other conditions and considerations may be taken into account by an on-board controller or ground controller for optimizing the actuator settings and, thus, the reflector configuration.

The reconfigurable reflector can also be used for controlling interference and counteracting intentional jamming, e.g., in military applications. In this case, uplink receivers (not shown) and an on-board or ground controller are used to determine the presence of intentional or unintentional interference. Geolocation of the uplink interferer may be achieved through dynamic beam steering via the reconfigurable reflector in a manner similar to monopulse tracking. Then, the controller can determine an adjustment to the reflector facet positions to produce a pattern null in the direction of the interference. These adjustments are made by the actuators 106. In a similar manner, tracking the received signal strengths of uplink beacons or carriers from different regions of the coverage area can be used to implement on-board or ground-based pattern adjustments to compensate for propagation impairments, primarily rain fading.

FIG. 1A shows reflector 100 in two different configurations. The left reflector 100 shows the reflector facets 104 forming a first configuration; the right reflector 100 shows the reflector facets 104 forming a second configuration. For example, in the transition from the left reflector configuration to the right reflector configuration, the top actuator 106 of the reflector 100 moves the connected reflector facet 104 towards the backing structure 102. The second actuator 106 from the top moves the connected reflector facet 104 away from the backing structure 102. Thus, while in the left reflector configuration, the topmost reflector facet 104 was farther from the backing structure 102 than the second reflector facet 104 from the top, their relative positions are swapped in the right reflector configuration.

As shown in FIG. 1A, the backing structure 102 is concave. The actuators 106 extend roughly perpendicular to the backing structure 102, making the reflector surface 108 formed by the reflector facets 104 generally concave. For example, all of the actuators 106 were set so that the reflector facets 104 reached the reference line 110, each reflector facet 104 would be the same distance from the backing structure 102. In this case, the reflector facets 104 collectively from a roughly continuous concave surface.

An exemplary arrangement of the reflector facets 104 is shown in FIG. 1B. The reflector facets 104 fit together to form a nearly continuous reflector surface 108. The reflector facets 104 are drawn as forming a flat surface, although as shown in FIG. 1A, they may form a parabolic surface or other type of curved surface. If the reflector facets 104 form a curved surface, they may be positioned relative to each other such that two reflector facets 104 at their outermost positions (i.e., as far to the right of the dotted line in FIG. 1A as they can reach) will not overlap. If the orientation of reflector facets 104 allows the possibility overlapping positions, the surface optimization algorithms should preclude solutions that cause physical interference between reflector facets 104 so that they do not damage each other.

In FIG. 1A, all reflector facets 104 drawn are shown connected to an actuator 106, which allows each of the reflector facets 104 positions to be adjusted. In other embodiments, not every reflector facet 104 is connected to the backing structure 102 by an actuator 106. For example, the centermost or outermost reflector facets 104 may be connected to the backing structure 102 by a fixed, non-adjustable connecting rod.

Figure 2A:
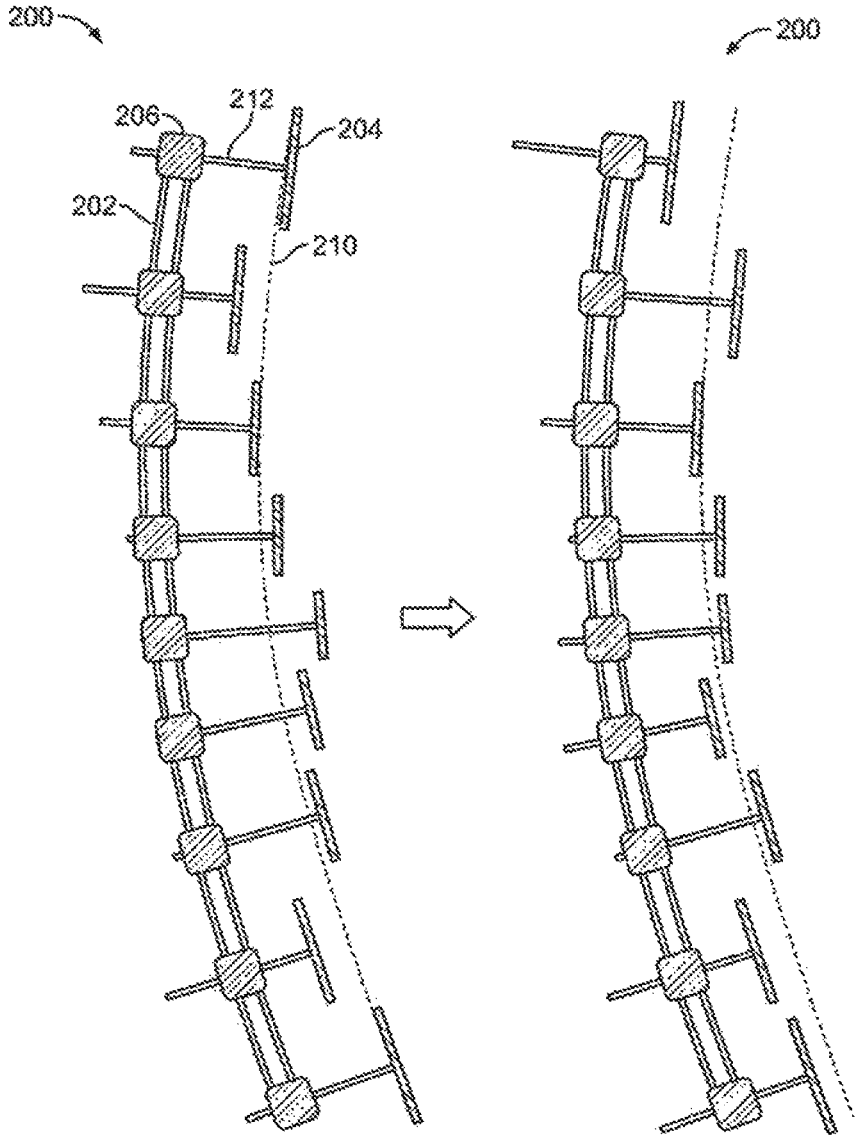
FIG. 2A is a side view of a reconfigurable reflector with reflector facets of various sizes, according to an illustrative embodiment of the invention.
Figure 2B:
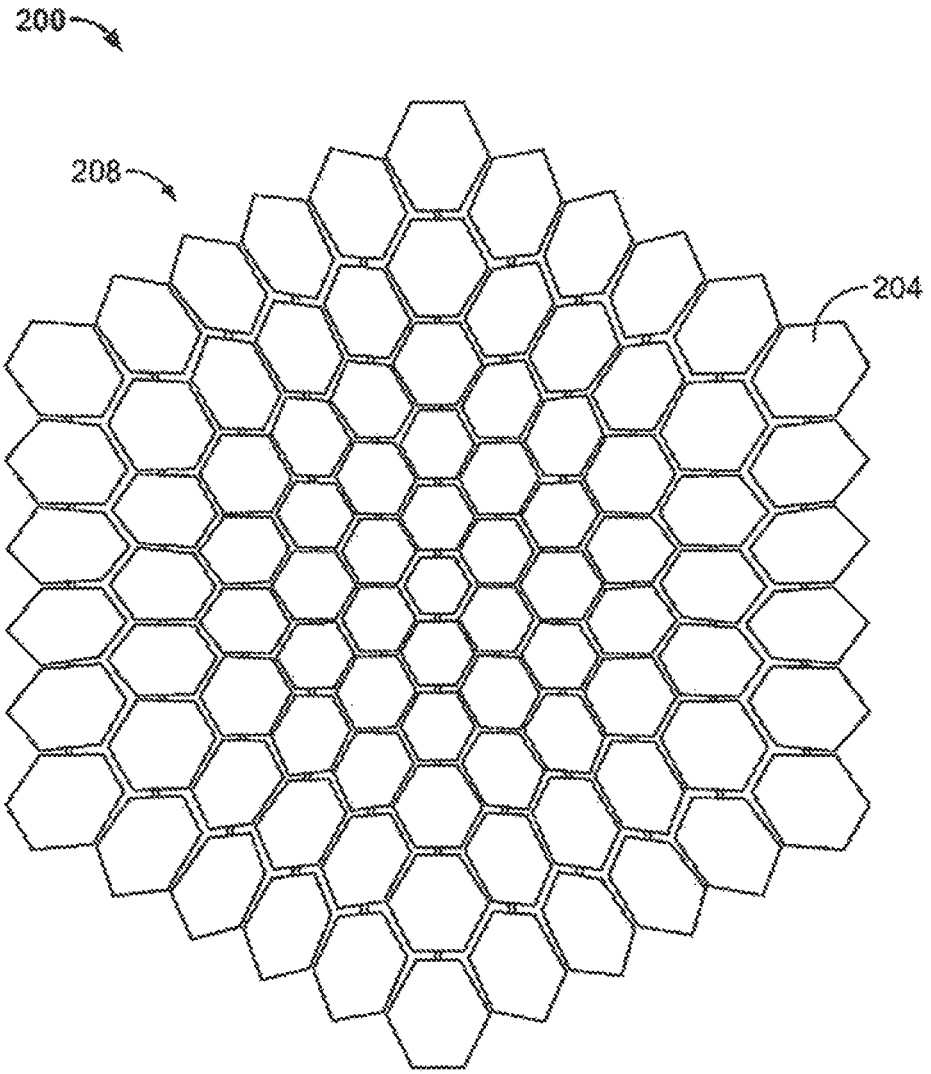
FIG. 2B is a front view of the reconfigurable reflector of FIG. 2A, according to an illustrative embodiment of the invention.

The reflector 100 can include any number of reflector facets 104 and actuators 106, depending on the desired size of the reflector 100, the desired size of the reflector facets 104, the desired weight of the reflector 100, and other factors. In some embodiments, the reflector facets 104 are on the order of several inches in diameter, in embodiments each facet has a maximum dimension of from 1 to 7 inches across it respective face, and the reflector 100 is on the order of several meters in diameter. As shown in FIGS. 2A and 2B, reflector facets 104 can be of different shapes and sizes. Including triangular and rectangular.

An exemplary reflector 200 made up of differently sized and shaped reflector facets is shown in FIGS. 2A and 2B. FIG. 2A shows two different configurations of a reflector 200, which is made up of a backing structure 202, multiple reflector surfaces 204, multiple actuators 206, and multiple connecting rods 212. Reflector 200 and its component parts are similar to reflector 100 and its component parts, but unlike reflector surfaces 104, reflector surfaces 204 are varying sizes. In particular, the reflector surfaces 204 towards the center of the reflector 200 are smaller than the reflector surfaces 204 towards the edge of the reflector 200.

The varying sizes and shapes of reflector facets 204 are also shown in FIG. 2B. At the center of the reflector 200, the innermost reflector facet 204 is a small, regular hexagon. Moving outward, the reflector facets 204 become larger and less regular. At the edge of the reflector 200, the reflector facets 204 are the largest in the reflector 200 and are elongated. While reflector facets 104 and 204 are all hexagons, other shapes may be used, and a combination of different shapes may be used. For example, reflector facets 104 or 204 may be circular, hexagonal, rectangular, square, super-elliptical, trapezoidal, or triangular.

While FIGS. 1A-2B show reflector facets 104 or 204 that can be moved in a single-axis of linear translation, in some embodiments, different types of movement may be enabled by different or additional actuators, up to a full six degrees of freedom (three translational and 3 rotational). For example, the reflector facets 104 or 204 may be able to tilt or pivot in one or more directions. This may be enabled by a tilt mechanism upon which a reflector facet is mounted. As another example, a different actuator may enable translation of reflector facets 104 or 204. For example, an actuator 106 or 206 may be mounted on a beam, and a mechanism may move the actuator along the beam, thus translating its connected reflector facet in a direction parallel to the beam. These or other mechanisms or actuators may be combined to provide an increased range of motion. Any of these mechanisms or actuators may be implemented on all or some of the reflector facets.

In some embodiments, the reconfigurable reflector may not be reconfigurable on-orbit but instead is only reconfigurable on the ground prior to launch. In such embodiments, the on-orbit controls discussed above are not needed. In addition, the actuators 106 may be replaced by a simple mechanical adjusting mechanism, such as a screw or other mechanical device. The positions of the facets 104 can be set late in the satellite manufacturing process, providing greater flexibility over fixed reflectors by allowing the operator or acquirer to configure the reflector before launch, after the final orbital slot and coverage region, for example, have been selected. Furthermore, if any manufacturing errors, damage, and/or misalignments are detected before launch, adjustments to the positions of facets 104 can be made to minimize the effects of such errors.

The reflectors 100 and 200 described above may be implemented as main reflectors and/or sub-reflectors in various implementations. Four possible reconfigurable antenna configurations are shown in FIGS. 3A-3D.

Figure 3A:
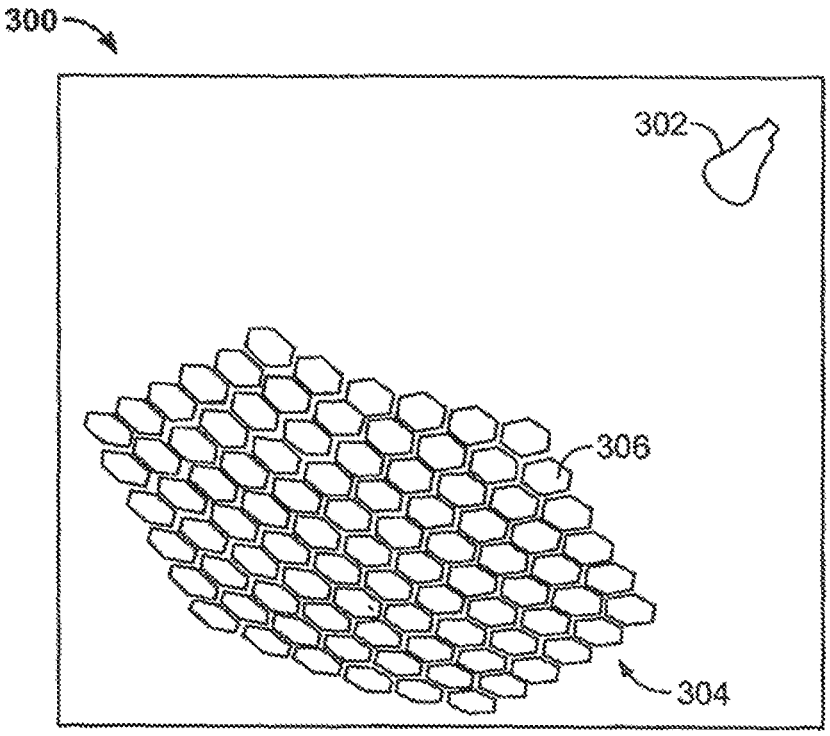
FIG. 3A is a model of a reconfigurable main reflector in a single offset reflector, according to an illustrative embodiment of the invention.

FIG. 3A is a model of a single offset reflector (SOR) antenna system 300. The antenna system includes an antenna feed 302 and a reconfigurable reflector 304 made up of reflector facets 306. The reconfigurable reflector 304 has a similar structure to reflectors 100 and 200 discussed above: the reflector facets 306 are mounted to a backing structure (not shown), and the reflector facets' positions are controlled by actuators (not shown). The antenna feed 302 transmits radiation in the direction of the reflector 304, which reflects the radiation, usually towards Earth. The pattern of the reflected radiation is determined by the configuration of the reflector 304. By adjusting the positions of the reflector facets 306 with actuators (e.g., actuators 106 or 206), the pattern of the reflected radiation will also be adjusted. Two exemplary reflector configurations and their corresponding reflected radiation patterns are shown in FIGS. 4A-4D.

Figure 3B:
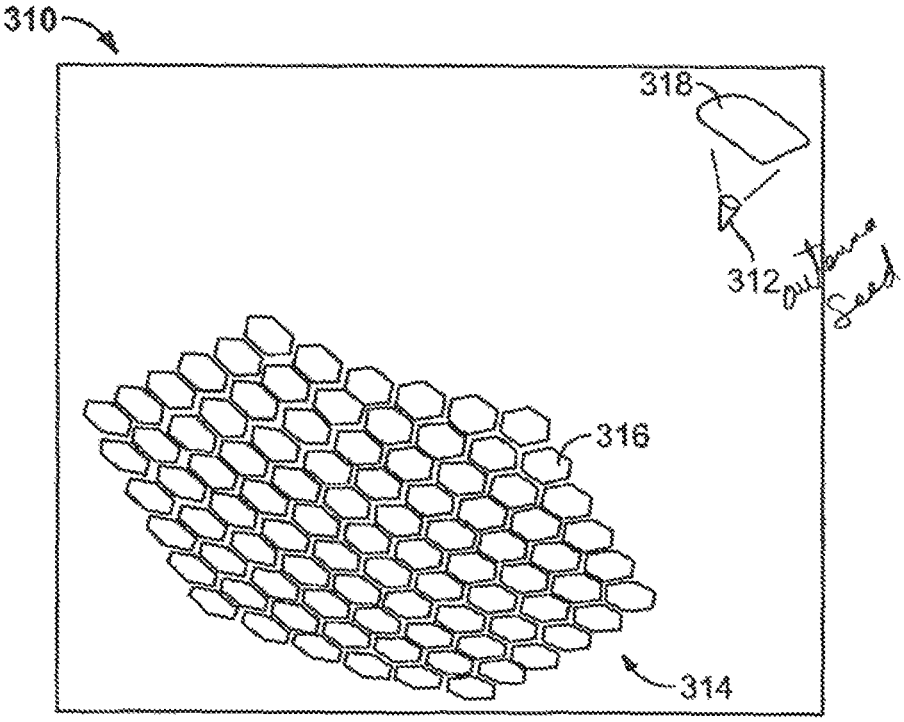
FIG. 3B is a model of a dual offset reflector having a reconfigurable main reflector and a fixed configuration sub-reflector, according to an illustrative embodiment of the invention.

FIG. 3B is a model of a dual offset reflector (DOR) antenna system 310 with a reconfigurable main reflector 314 made up of reflector facets 316. The reconfigurable main reflector 314 is similar to reconfigurable main reflector 304 in FIG. 3A. The DOR antenna system 310 further includes an antenna feed 312 and a sub-reflector 318, which is not reconfigurable. The antenna feed 312 transmits radiation in the direction of the sub-reflector 318, which reflects this radiation in the direction of the main reflector 314, which then reflects the radiation, e.g., towards Earth. In this case, while the sub-reflector 318 may impact the radiation pattern, changes to the radiation pattern are created by adjusting the positions of the reflector facets 316 of the reconfigurable main reflector 314.

Figure 3C:
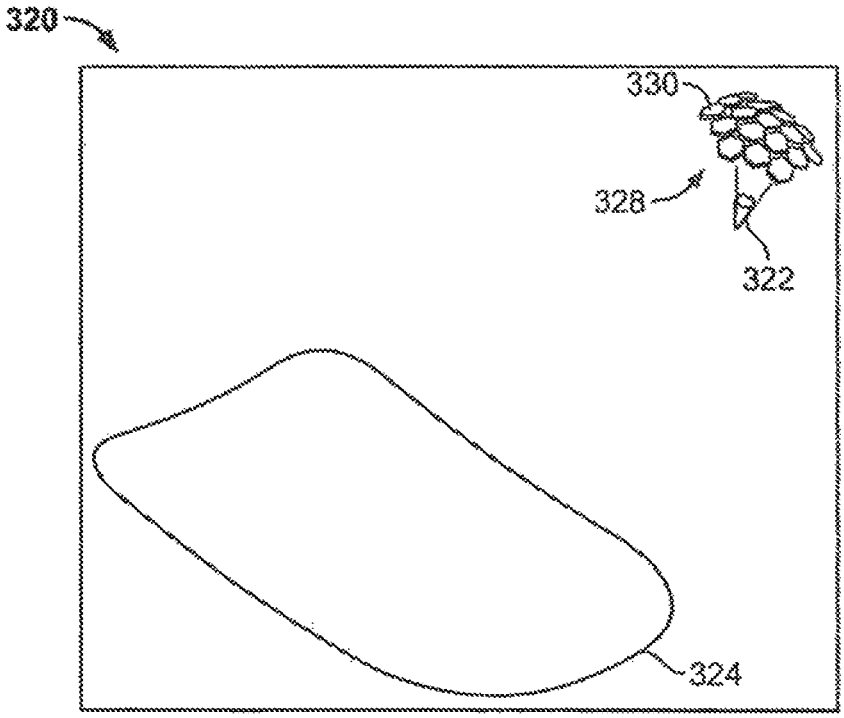
FIG. 3C is a model of a dual offset reflector having a fixed configuration main reflector and a reconfigurable sub-reflector, according to an illustrative embodiment of the invention.

FIG. 3C is a model of a dual offset reflector (DOR) antenna system 320 having an antenna feed 322, a fixed configuration main reflector 324, and a reconfigurable sub-reflector 328. The reconfigurable sub-reflector 328 is made up of sub-reflector facets 330. The structure of the sub-reflector 328 is similar to the structure of the reflector 100 described above. The DOR antenna system 320 operates in a similar manner to DOR antenna system 310, but changes in the final radiation pattern reflected by the fixed main reflector 324 are created by adjusting the positions of the sub-reflector facets 330 rather than facets of the main reflector 324.

Figure 3D:
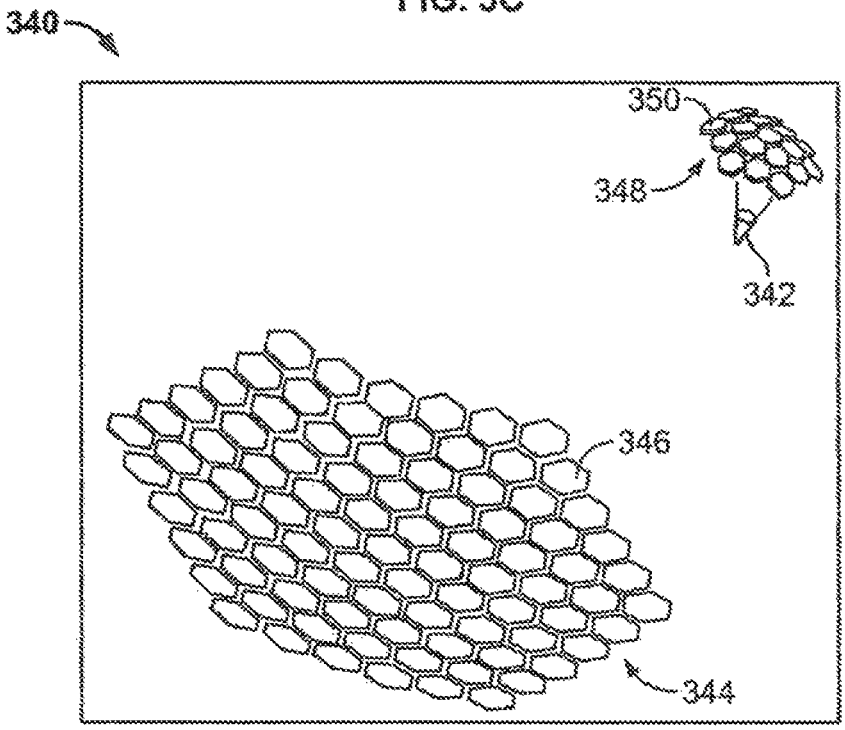
FIG. 3D is a model of a dual offset reflector having a reconfigurable main reflector and a reconfigurable sub-reflector, according to an illustrative embodiment of the invention.

FIG. 3D is a model of a dual offset reflector (DOR) antenna system 340 having an antenna feed 342, a reconfigurable main reflector 344, and a reconfigurable sub-reflector 348. The reconfigurable main reflector 344 is made up of reflector facets 346, and the reconfigurable sub-reflector 348 is made up of sub-reflector facets 350. The DOR antenna system 340 operates in a similar manner to DOR antenna systems 310 and 320, but changes in the final radiation pattern reflected by the fixed main reflector 344 can be created by adjusting the positions of the sub-reflector facets 350 of the sub-reflector 348 and/or by adjusting the positions of the reflector facets 346 of the main reflector 344.

Figure 4A:
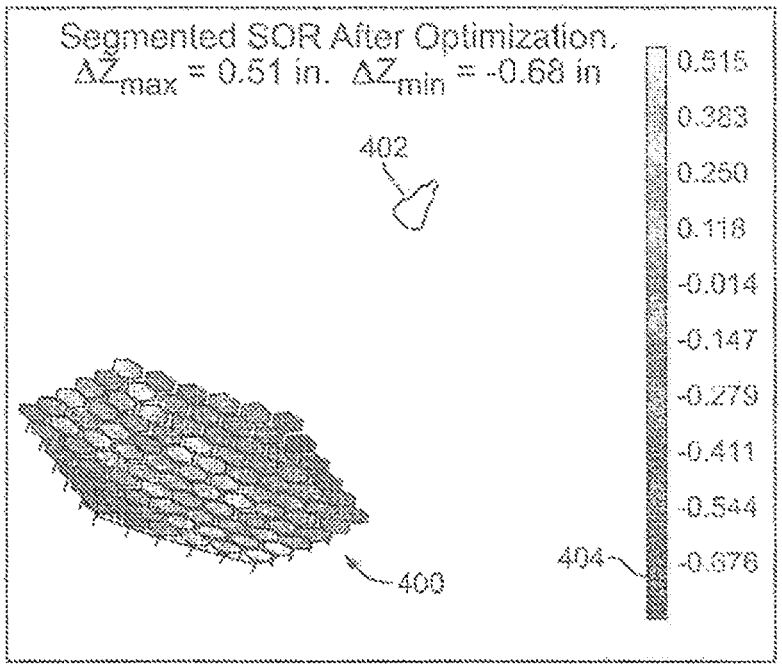
FIG. 4A is a model of a reconfigurable single offset reflector configured for Africa/Europe coverage, according to an illustrative embodiment of the invention.

FIG. 4A is a model of a reconfigurable single offset reflector (SOR) 400 configured for Africa/Europe coverage. The SOR is similar to reconfigurable reflector 100 shown in FIGS. 1A-1B. The reflector facets have been offset from a reference position (e.g., the curved dotted line shown in FIG. 1A) by up to 0.68 inches along a single linear dimension. In the model of FIG. 4A, the distance from the reference position for each reflector facet is indicated by shading. The shading bar 404 indicates the distance from the reference position that each shade corresponds to. For example, the lightest reflector facets in reflector 400 are at a distance of approximately 0.515 inches above the reference position, and the next lightest reflector facets in reflector 400 are at a distance of approximately 0.383 inches above the reference position, and so forth.

Figure 4C:
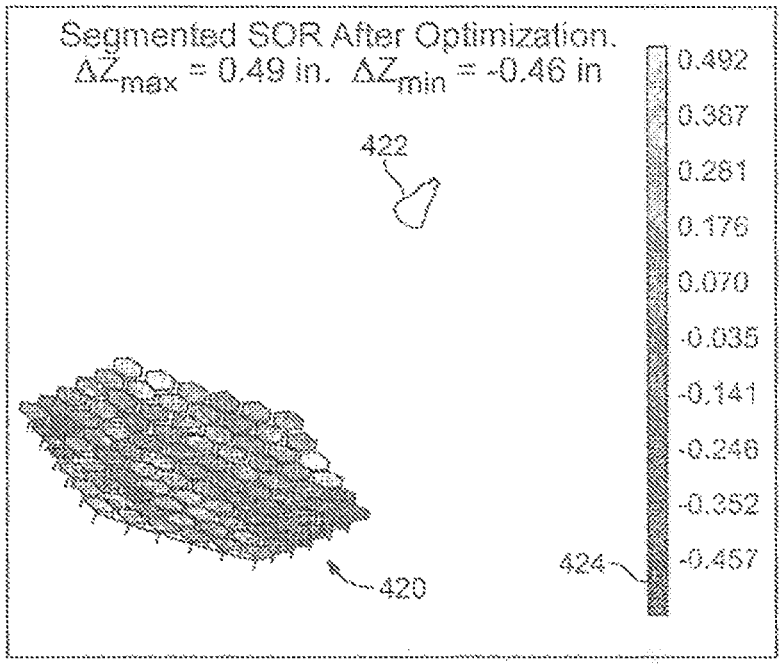
FIG. 4C is a model of a reconfigurable single offset reflector configured for CONUS coverage, according to an illustrative embodiment of the invention.
Figure 4B:
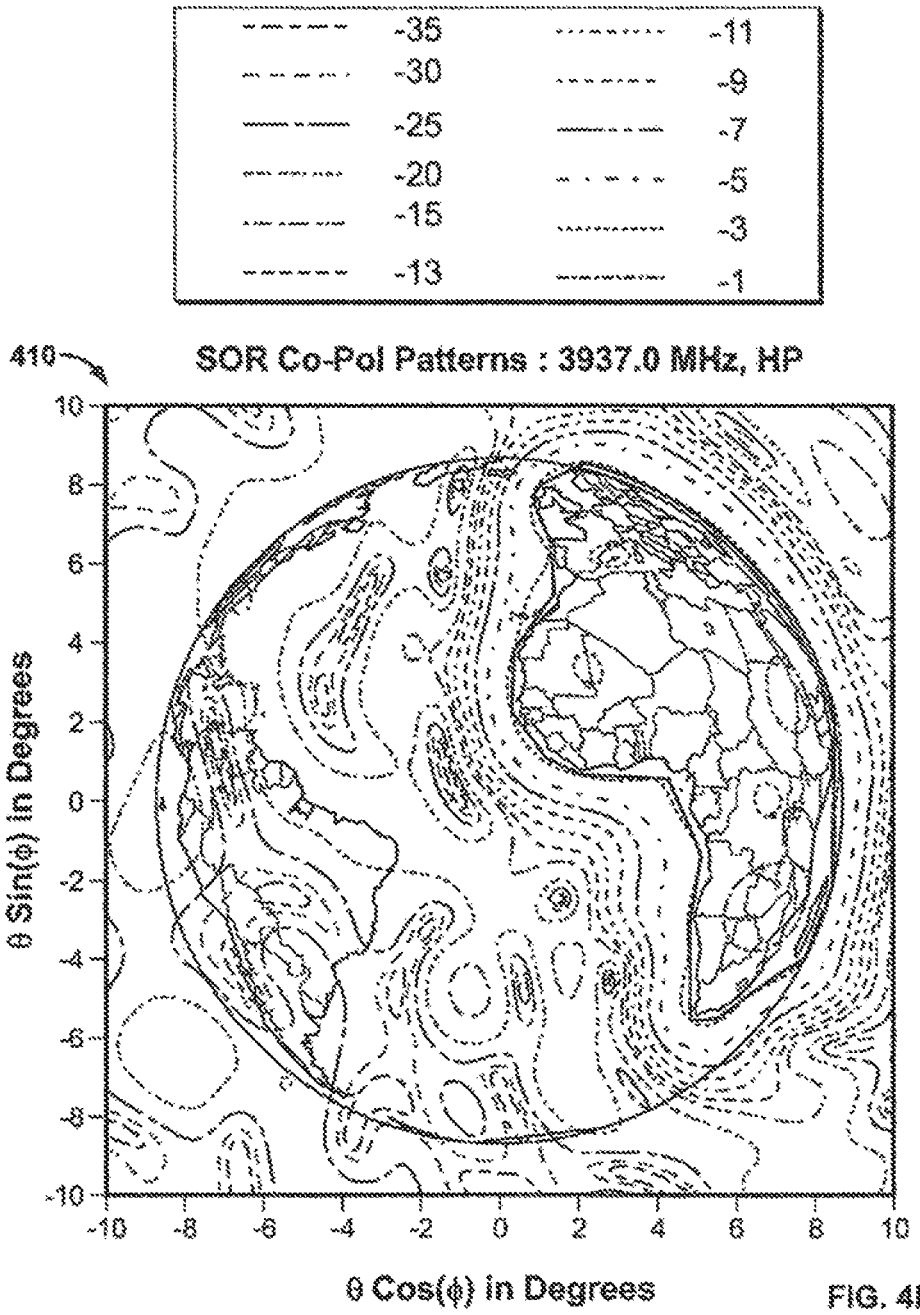
FIG. 4B is the coverage map of the single offset reflector configured for Africa/Europe coverage modeled in FIG. 3A, according to an illustrative embodiment of the invention.

When the reflector 400 is illuminated by the feed 402 shown in FIG. 4A, the reflector 400, when positioned at the orbital slot that the configuration of the reflector 400 was optimized for, would have the far-field co-polarization radiation pattern shown in FIG. 4B. The coverage map 410 in FIG. 4B shows that the radiation pattern covers Africa and Europe. Outside of the African and European landmasses, the amount of radiation reaching the Earth quickly drops off. Thus, while the desired landmasses receive a strong signal, the satellite would not be expending power sending a strong signal to areas outside the intended coverage area (e.g., the ocean).

FIG. 4C is a model of a reconfigurable single offset reflector (SOR) 420 configured for coverage of the continental United States (CONUS). The SOR 422 may be the same reflector as reconfigurable reflector 400 shown in FIG. 4A, but the positions of its reflector facets have been reconfigured so that the reflector is optimized for CONUS coverage, and it has moved to a different orbital position. The reflector facets have been offset from the reference position by up to about a half an inch. As in FIG. 4A, the distance from the reference position for each reflector facet is indicated by shading.

Figure 4D:
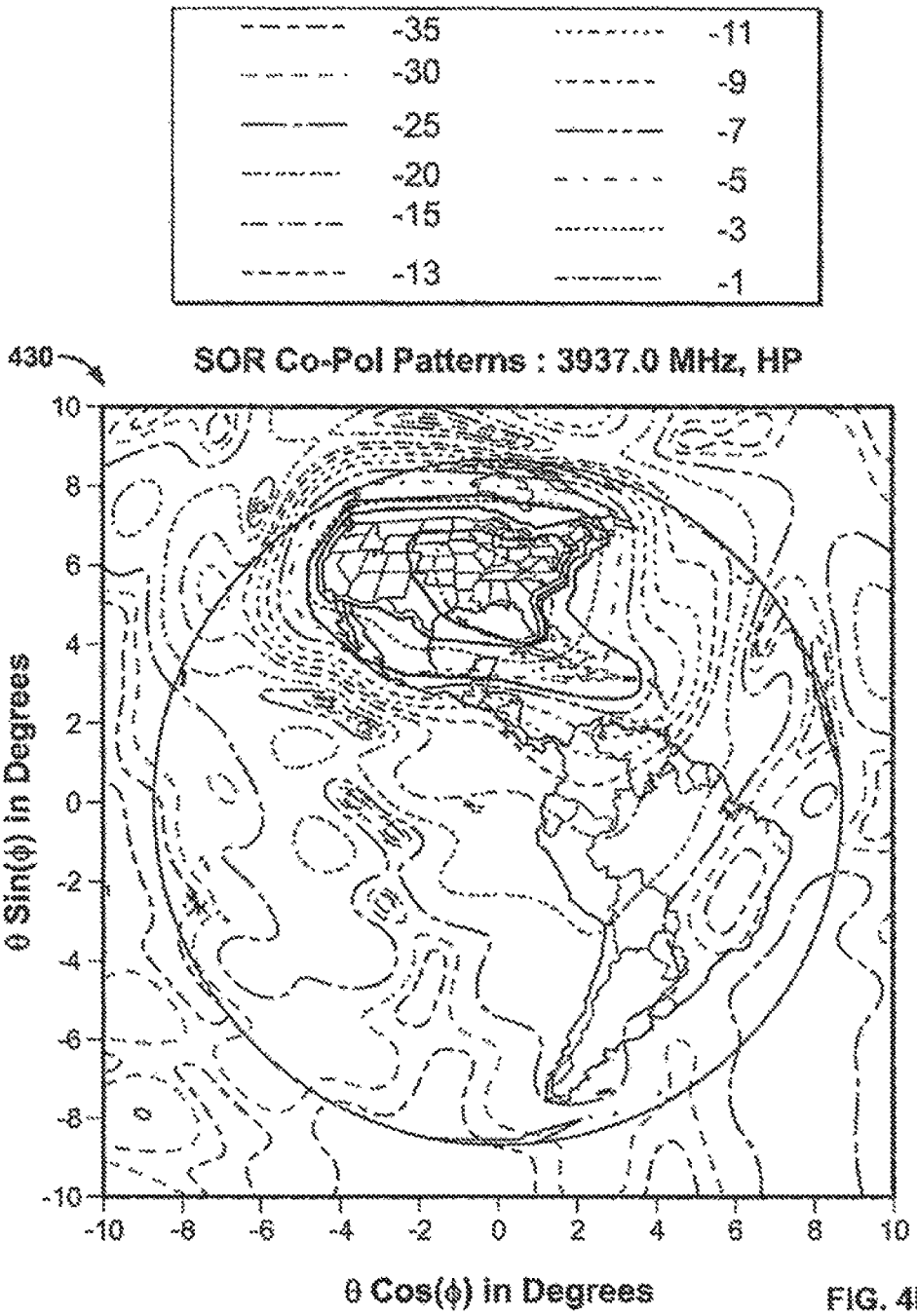
FIG. 4D is the coverage map of the single offset reflector configured for CONUS coverage modeled in FIG. 3C, according to an illustrative embodiment of the invention.

When the reflector 420 is illuminated by the feed 422 shown in FIG. 4C, the reflector 420, when positioned at the orbital slot the configuration of reflector 420 was optimized for, would have the far-field co-polarization radiation pattern shown in FIG. 4D. The coverage map 430 in FIG. 4D shows that the radiation pattern covers CONUS. Outside of the continental US, the amount of radiation reaching the Earth drops off. Thus, while the desired coverage area receives a strong signal, the satellite would not be expending power sending a strong signal to areas outside the intended coverage area (i.e., the ocean, Canada, or Mexico).

Figure 5A:
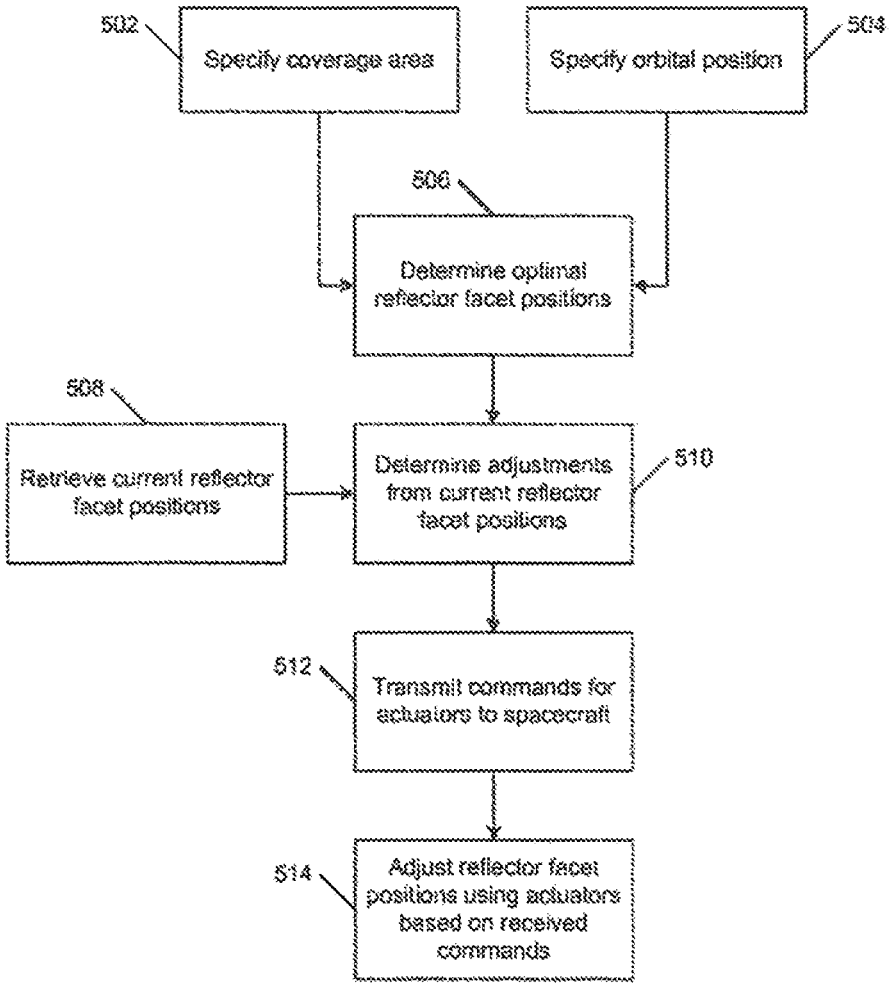
FIG. 5A is a flowchart for configuring a reconfigurable reflector on-orbit, according to an illustrative embodiment of the invention.

FIG. 5A is a flowchart showing a method for configuring a reconfigurable reflector on-orbit. First, a desired coverage area or beam shape is specified by an operator at a ground station (step 502). For example, an operator may input data specifying that the reflector should be configured for Africa/Europe coverage, as shown in FIG. 4A or CONUS, as shown in FIG. 4C. Data describing various pre-defined coverage areas or beam shapes may be available to the operator, or the operator may input the bounds of the coverage area or region to be covered, along with any other antenna pattern constraints. The operator also specifies the orbital position (step 504), for example, as latitude for a geostationary orbit.

Based on this information, a ground-based or on-orbit processor determines the optimal positions for the reflector facets to achieve the desired directivity pattern (step 506). The desired directivity pattern may be contoured to the desired coverage area and may minimize antenna directivity to directions and areas outside of the desired coverage area. The optimal positions may be constrained by the range of motion and types of motion (e.g., linear motion perpendicular to the backing structure, pivot motion, other degrees of translation) available to the reflector facets, and may take into account that different reflector facets have different ranges and types of motion available, as discussed above. The positions may also be constrained by actuator or reflector facet failures, as discussed above. The algorithm for determining the optimal position may be similar to algorithms used for designing fixed-shaped continuous reflectors. The algorithm may also consider the diffraction or scattering effects created by discontinuities in the reflector surface.

The processor also retrieves the current facet positions (step 508). This could be telemetered directly from the individual actuators or determined via on-board photogrammetry of optical targets placed on the surfaces of the facets, as discussed above. Based on the optimal reflector facet positions determined in step 506 and the current reflector facet positions, the processor determines the adjustments to be made from the current reflector facet positions to obtain the optimal reflector facet positions (step 510). The processor then outputs these adjustments and, in the case of ground-based processing, they are transmitted by the ground station to the spacecraft (step 512). The spacecraft's command and data-handling subsystem relays signals to the actuators, causing the actuators to adjust the reflector facet positions according to the received commands (step 514).

One or more of the steps preceding step 512 may be performed on the spacecraft rather than at a ground station. For example, the spacecraft may store the current reflector facet positions and, based on these positions, determine the adjustments from the current reflector facet positions (step 510). As another example, anti jamming adjustments described in relation to FIG. 1 may be performed entirely by on-board equipment, without operator intervention. The method described above can also be applied to the dual-reflector configurations shown above, but the processor would determine the positions of facets of a sub-reflector rather than, or in addition to, facets of the main reflector.

Figure 5B:
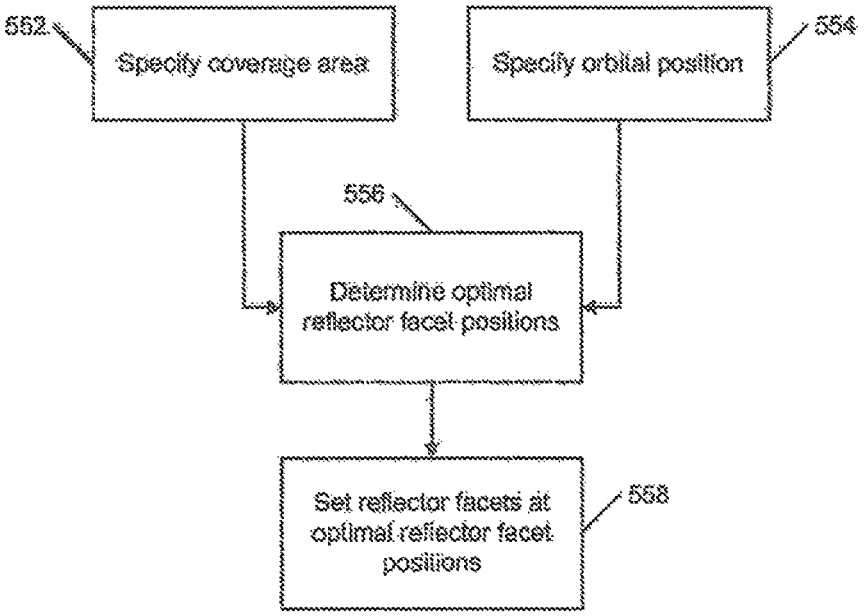
FIG. 5B is a flowchart showing a method for configuring a reconfigurable reflector prior to launch, according to an illustrative embodiment of the invention.

FIG. 5B is a flowchart showing a method for configuring a reconfigurable reflector prior to launch. First, a desired coverage area or beam shape is specified by a manufacturer or operator (step 552). For example, after the coverage region has been assigned, the manufacturer may input data specifying that the reflector should be configured for Africa/Europe coverage, as shown in FIG. 4A or CONUS, as shown in FIG. 4C. Data describing various pre-defined coverage areas or beam shapes may be available to the manufacturer, or the operator may input the bounds of the coverage area or region to be covered. The manufacturer or operator also specifies the orbital position (step 554), for example, as latitude for a geostationary orbit.

Based on this information, a processor determines the optimal positions for the reflector facets to achieve the desired radiation pattern (step 506). The desired directivity pattern may be contoured to the desired coverage area and may minimize antenna directivity to directions and areas outside of the desired coverage area. The optimal positions may be constrained by the range of motion and types of motion (e.g., linear motion perpendicular to the backing structure, pivot motion, other degrees of translation) available to the reflector facets, and may take into account that different reflector facets have different ranges and types of motion available, as discussed above. The positions may also be constrained by any manufacturing errors, damage, or misalignments, as discussed above. The algorithm for determining the optimal position may be similar to algorithms used for designing fixed-shaped continuous reflectors. The algorithm may also consider the diffraction or scattering effects created by discontinuities in the reflector surface.

After calculating the optimal reflector facet positions, the processor then outputs the optimal reflector that positions to the manufacturer, who sets the facets at their optimal positions (step 558). In some embodiments, the facet positions may be manually set by the manufacturer using one or more manual mechanical adjustors coupled to each facet. In other embodiments, the facets may be automatically set at their optimal positions using actuators as described in relation to FIG. 5A.

Figure 6:
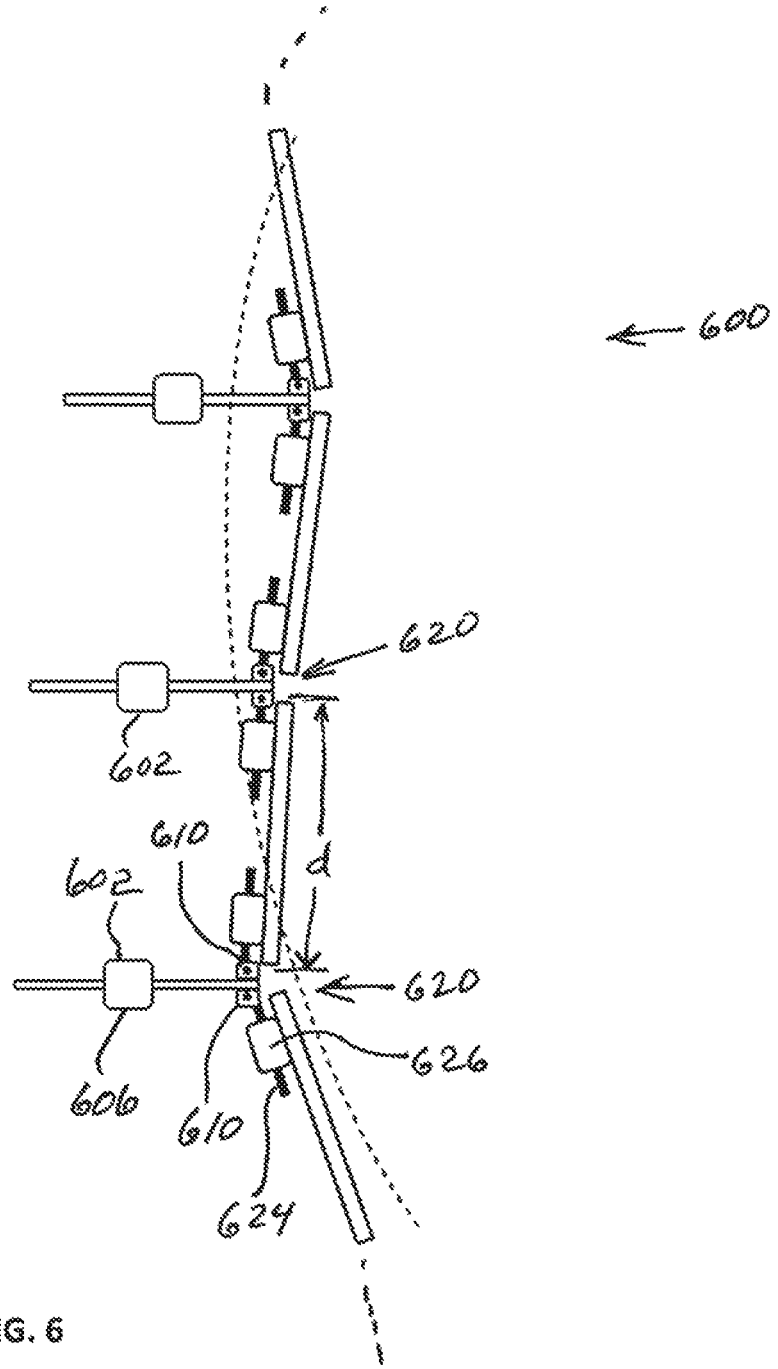
FIG. 6 is a side view of a cross section showing a column of facets and actuators of a reconfigurable reflector.

Referring to FIG. 6, another embodiment is illustrated where a reflector 600 has adjustment mechanisms 602 including actuators 606 that are connected at pivot points 610, to two or more facets. Accommodators 612 allows the distance d between pivot points to change. The accommodator may be any of several mechanical devices that maintain some degree of structural immobility to the connections between the actuators and the facets. The accommodators may be rods 624 in brackets 626 having bore holes sized to the rods. Telescoping members, linkages, and other mechanisms may be suitable. Resistance to sliding may be provided by friction between members of the accommodators. Also biases may be provided, such as by springs, for having a neutral location of the accommodator. Although FIG. 6 illustrates the actuator connected to two facets which would be suitable if the connection 620 is at adjacent edges of facets. If the actuator is at nodes/corners, then, in certain reflectors, for example with hexagonal facets, single actuator may connect to three facets. Each facet may have a shared actuator at each node. See U.S. Pat. No. 6,982,681 for an example of an actuator connected to four corners of four facets in a different application. Said publication is incorporated by reference herein for all purposes. The accommodators may be screw drives or other linear motors as well.

While preferable embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A method for antenna pattern shaping of a geostationary communications satellite in orbit, the satellite having a reconfigurable faceted reflector and an antenna feed for illuminating the reconfigurable faceted reflector, the method comprising:

selecting a desired coverage area on Earth;

determining, based on the orbital position of the satellite and the desired coverage area on Earth, optimal positions for each of a plurality of reflector facets for radiating the desired coverage area, wherein the plurality of reflector facets are coupled to a plurality of adjusting mechanisms; and adjusting, while the satellite is in orbit, using the plurality of adjusting mechanisms, the positions of the plurality of reflector facets to the determined optimal positions for the plurality of reflector facets.

2. The method of claim 1, wherein the determining optimal positions for each of the plurality of reflector facets is accomplished by way of a ground controller and transmitting commands relative to the optimal positions to satellite.

3. The method of claim 2, wherein determining the optimal positions of the plurality of reflector facets is further based on receiving a failure condition of at least one of the actuators.

4. The method of claim 1, wherein each of the adjusting mechanisms comprises a linear actuator, and the commands for adjusting the plurality of reflector facet positions are commands for independently adjusting each of the linear actuators to move each of the plurality of reflector facets towards or away from a backing structure to which each of the adjusting mechanisms is attached.

5. The method of claim 1, wherein the plurality of reflector facets, the plurality of adjusting mechanisms, and a backing structure form a main reflector, the method further comprising:

determining optimal positions of a second plurality of reflector facets coupled to a second plurality of adjusting mechanisms and mounted to a second backing structure;

wherein the second plurality of reflector facets, the second plurality of adjusting mechanisms, and the second backing structure form a sub-reflector.

6. The method of claim 1, the method further comprising:

receiving a second desired coverage area that is different from a first desired coverage area;

determining, based on the second desired coverage area, second optimal positions for the plurality of reflector facets for radiating the second desired coverage area; and transmitting, to the plurality of adjusting mechanisms, commands for adjusting the plurality of reflector facet positions to the determined second optimal positions of the plurality of reflector facets for radiating the second desired coverage area.

7. The method of claim 1, further comprising determining optimal positions of the multiple reflector facets by a ground-based processing and transmitting instructions to the satellite relating to the optimal positions by telemetry to the satellite.

8. A communications satellite having a transmitter to transmit radiation and a reconfigurable reflector to reflect the radiation towards Earth, the reconfigurable reflector being on the order of several meters in diameter, the reflector comprising:

a backing structure;

multiple adjusting mechanisms mounted to the backing structure, each adjusting mechanism including an actuator; and discrete multiple reflector facets, each reflector facet being on the order of several inches, wherein the multiple reflector facets are coupled to the multiple adjusting mechanisms for adjusting the position of the reflector facets; wherein the reflector facets are adjustable by way of the multiple adjusting mechanisms to produce a first antenna pattern, the first antenna pattern contoured to a desired coverage area of Earth so that radiation transmitted by the transmitter is reflected towards Earth with a beam shape optimized for the desired coverage area; and the reflector facets are further adjustable to produce a second antenna pattern, the second antenna pattern contoured to a different desired coverage area of Earth so that radiation transmitted by the transmitter is reflected towards Earth with a beam shape optimized for the different desired coverage area so that radiation transmitted by the transmitter is reflected towards Earth with a second beam shape optimized for the second desired coverage area.

9. The satellite of claim 8, wherein each of the plurality of adjusting mechanisms is associated with a discrete reflector facet.

10. The satellite of claim 9, wherein each of the plurality of adjusting mechanisms is a linear actuator.

11. The satellite of claim 8, further comprising a plurality of fixed reflector facets that are mounted to the backing structure and are not coupled to an adjusting mechanism.

12. The satellite of claim 8, wherein a plurality of reflector facets are tillable.

13. The satellite of claim 8, wherein each of a subset of the plurality of reflector facets is curved.

14. The satellite of claim 8, wherein at least one of the plurality of reflector facets is differently sized from at least another one of the plurality of reflector facets.

15. The satellite of claim 8, wherein the backing structure profile is one of parabolic, ellipsoidal, flat, hyperbolic, and spherical.

16. The satellite of claim 8, wherein each adjusting mechanism is a tilting mechanism for tilting one of the plurality of reflector facets to tilt the corresponding one of the plurality of reflector facets relative to the backing structure.

17. The satellite of claim 8, further comprising a plurality of translating mechanisms, wherein the each of the plurality of translating mechanisms is coupled to a corresponding one of the plurality of reflector facets to tilt the corresponding one of the plurality of reflector facets relative to the backing structure.

18. A communications satellite having a transmitter to transmit radiation and a reconfigurable reflector to reflect the radiation towards Earth, the reconfigurable reflector comprising:

a backing structure;

multiple adjusting mechanisms mounted to the backing structure;

multiple actuators for adjusting the multiple adjusting mechanisms; and multiple reflector facets, wherein at least a subset of the multiple reflector facets are adjustable by way of the multiple actuators;

wherein the reflector facets are adjustable to produce a first antenna pattern contoured to a desired coverage area of Earth so that radiation transmitted by the transmitter is reflected towards Earth with a beam shape optimized for the desired coverage area and the reflector facets are adjustable to produce a second antenna pattern different from the first antenna pattern.

19. The communications satellite of claim 18, further comprising a processor on board the satellite configured for determining optimal positions of each of the multiple reflector facets.

20. The communications satellite of claim 18, wherein each of the subset of the multiple reflector facets are tiltable.

* * * * *